United States Patent [19]

McDougle

[11] 4,263,749

[45] Apr. 28, 1981

[54] GATE SUPPORT

[76] Inventor: Joseph A. McDougle, Rte. 3, Box 16, Florence, Ala. 35630

[21] Appl. No.: 86,971

[22] Filed: Oct. 22, 1979

[51] Int. Cl.[3] ..... E05B 65/06

[52] U.S. Cl. ..... 49/394; 49/396; 49/381; 49/366; 49/237; 292/187; 292/340

[58] Field of Search ..... 49/394, 237, 381, 366; 292/183, 189, 187, 133, 340, DIG. 19, DIG. 55

[56] References Cited

U.S. PATENT DOCUMENTS

| | | |
|---|---|---|
| 152,049 | 6/1874 | Roderick . |
| 920,305 | 5/1904 | Finch . |
| 2,599,211 | 6/1952 | Tilbury . |
| 2,703,728 | 3/1955 | Raber . |
| 2,940,790 | 6/1960 | Ingalls et al. . |
| 3,419,302 | 12/1968 | Frey et al. . |

*Primary Examiner*—Kenneth Downey
*Attorney, Agent, or Firm*—Dowell & Dowell

[57] ABSTRACT

An apparatus for use in elevating the movable end of the a swinging gate and for supporting and maintaining the end of gate in a predetermined position, whereby the locking drop rod of the gate may be selectively and cooperatively received by the apparatus to thereby lock the gate from further swinging movement.

4 Claims, 3 Drawing Figures

GATE SUPPORT

BACKGROUND OF THE INVENTION

Field of the Invention

This invention is generally related to locks and supports for swinging gates and particularly to a support for a swinging gate which includes a cradle for maintaining the free or movable end of the gate in a non-swinging elevated position with respect to the ground or paved surface over which the gate is disposed and which support includes a socket member which is located in a proper position so that when the gate is maintained within the supporting cradle, the locking drop rod of the gate may be vertically received within the socket member.

SUMMARY OF THE INVENTION

This invention is directed to a combination gate supporting device and latch socket for cooperatively supporting the free or movable end of a swinging gate while enabling the locking drop rod of the gate to be vertically received within the latch socket to thereby lock the gate in its supported position. The device includes at least one pair of opposed inclined members which are sloped upwardly toward one another from the base portion of the device and define a cradle area therebetween adjacent their uppermost portions in which the lower portion of the swinging gate may be cooperatively rested. A latching socket member is positioned adjacent the cradle area and such socket selectively and cooperatively receives the vertical drop rod or locking member which is carried adjacent the end of the gate.

It is the primary object of this invention to provide an apparatus for supporting the movable or free end of at least one swinging gate so that the stress on the gate hinges and the tendency of the gate to sag vertically will be compensated for while cooperatively aligning the drop rod locking mechanism of the gate in vertical disposition relative to a latching socket member of the apparatus.

It is another object of this invention to provide a support for the free end of a swinging gate which may be easily installed for use with an existing gate structure.

It is a further object of this invention to provide a combination gate support and gate latching socket apparatus which includes sloped gate elevating members which will assist in guiding the free end of the gate to an elevated position in which the free end of the gate is supported and the stress of the gate hinges is eliminated and which is shaped to minimize any potential damage to vehicle tires contacting the apparatus.

It is another object of this invention to provide a support for the free end of a swinging gate which supports the gate in such a position as to align a vertically movable drop rod with a socket member which will receive the end of the gate drop rod without requiring a separate subsurface retaining pipe or hole.

DESCRIPTION OF THE PREFERRED EMBODIMENT

Figure 1:
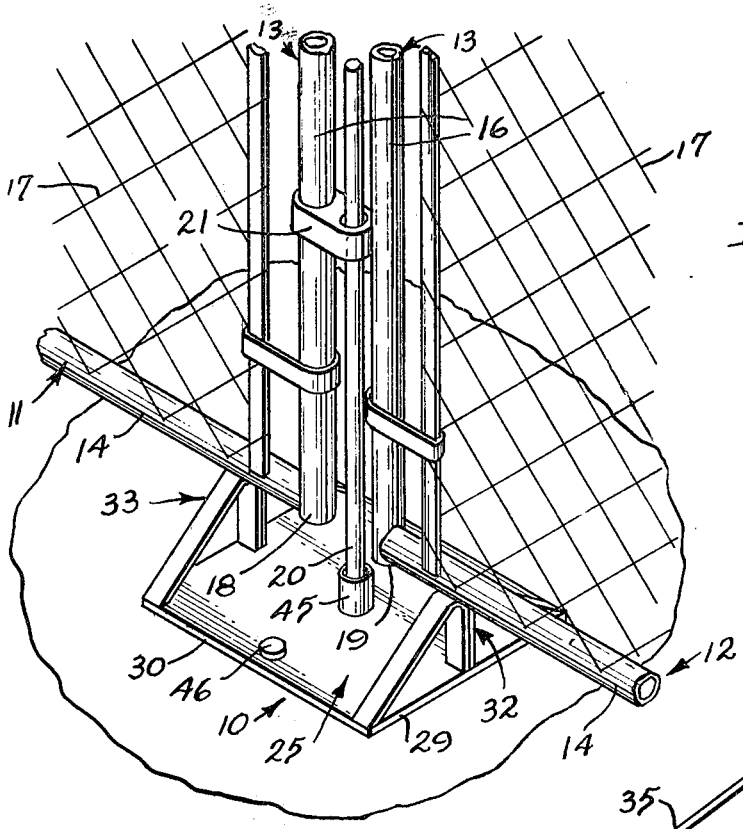
FIG. 1 is a perspective view illustrating the invention in use.
Figure 3:
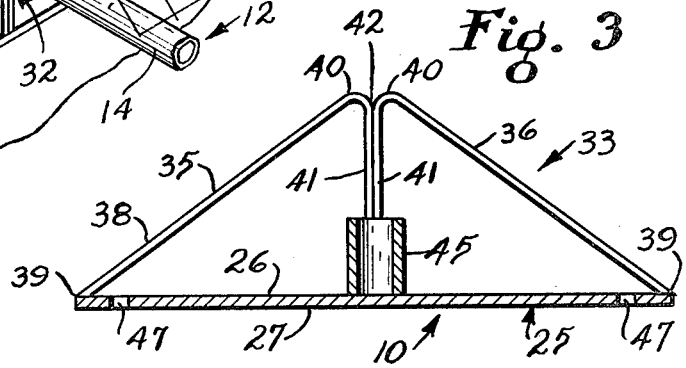
FIG. 3 is a sectional view taken along line 3—3 of FIG. 2.
Figure 2:
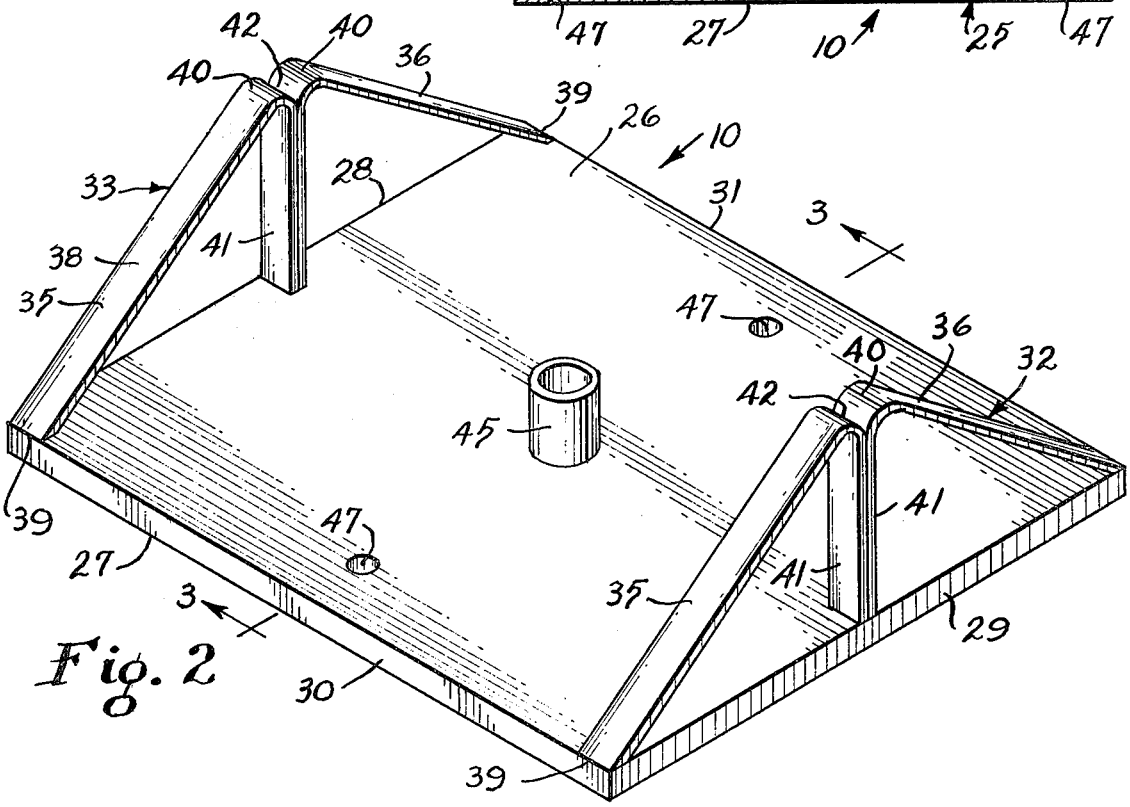
FIG. 2 is an enlarged perspective view of the invention per se.

With continued reference to the drawing, the gate support and retainer 10 of the present invention is illustrated in FIG. 1 as it is used with a double gate arrangement wherein opposed swinging gates 11 and 12 are shown in alignment with one another and closing an opening through a fence or the like (not shown). Each swinging gate includes a rigid frame portion 13 having upper and lower horizontally disposed framing bars 14, and generally vertically disposed end bars 16. A fence fabric 17 such as chain link wire is stretched between the frame members.

Although not shown, each gate 11 and 12 is pivotally mounted at one end to a support post by hinges or the like in a conventional manner. The gate frames 13 extend from the pivoted end of the gate outwardly to their free or movable ends. Gate 11 is shown as having a free end 18 and gate 12 as having a free end 19.

In order that gates 11 and 12 may be secured in a locked position when closed, as shown in FIG. 1, gate 11 is provided with a vertically adjustable locking drop rod 20 which is slidably mounted on gate 11 by a plurality of guide members 21 which are carried by the end bar 16. Although gate 12 may be equipped with a similar drop rod, which would permit gate 12 to be locked independently of gate 11, conventional latching structures are generally provided to selectively interlock gate 12 with gate 11. Such latching structures ordinarily are mounted adjacent the free end 19 of gate 12. For instance, U-shaped latch members could be pivotally mounted on the gate 12 so as to be brought into place straddling the vertical bar 16 of gate 11. A lock may then be placed through the pivoted arms of the latching member to prevent its rotational displacement from the vertical bar 16 of gate 11.

In lieu of a swinging U-shaped latch member, other types of interlocking arrangements may be used, such as a chain looped between the opposed vertical support bars 16. Additionally, gate 12 could have one or more drop rod guide members similar to the guide members 21 which could be vertically aligned with the guide members 21 so that the gates 11 and 12 could be independently or simultaneously locked by the drop rod 20.

The drop rod of conventional gate structures is normally received in a locking relationship with a pipe, channel or other opening or the like embedded or otherwise created in the surface over which the gates are disposed. Such openings or other receptacles must be embedded in the surface material at exactly the right position to insure proper alignment with the drop rod. Depending upon the type of surface material encountered, such as asphalt or concrete, the difficulty in creating such drop rod receivers may vary.

Additionally, as the weight of conventional swinging gates is cantilevered outwardly from the hinged mountings on support posts, such gates tend to sag or cause the support posts to be displaced either by bending or leaning so that the outer or free end of the gates may actually touch the surface over which the gates are disposed. Such cantilevered weight not only puts a strain on the gate hinges, but also makes gate manipulation and locking more difficult. For instance, if the gate is sloped or sagging when brought into a closed position, the drop rod may not be truly vertically oriented and thus the drop rod will not properly align with the locking receptacle or opening in the surface material. In such cases, the gate must be lifted vertically in order to permit the drop rod to be received within the locking opening.

In order to alleviate problems heretofore encountered in installing and locking swinging gates, the present invention is directed to a gate support or retainer 10 which may be quickly installed to both simultaneously support the free end of the gate, maintain the gate in position, and provide a latch socket for receiving a drop rod 20.

The gate retainer 10 includes a generally planar base 25 having an upper surface 26, lower surface 27, ends 28 and 29, and sides 30 and 31. A pair of gate rests 32 and 33 are mounted on the upper surface 26 of the base plate 25 adjacent either end 28 or 29 thereof, respectively.

Each gate rest is constructed having a pair of inclined ramp members 35 and 36 mounted in opposed and substantially abutting relationship with one another. The ramp members are generally inverted V-shaped structures having a first inclined leg 38 which extends from its outer end 39, which is welded or otherwise attached to the upper surface 26 of the base plate 25, upwardly and inwardly to an arcuate upper end 40 which joins the first leg 38 with the second leg 41. Leg 41 is vertically disposed from the arcuate upper end 40 downwardly to the base 25 and is welded or otherwise attached thereto.

It should be noted that the inclined surface or leg 38 of the ramp member 35 is oriented toward the side wall 30 of the base while the inclined leg 38 of the ramp member 36 is oriented toward the side wall 31 of the base. The vertical legs 41 of the ramp members are generally maintained in contact with one another. However, the arcuate upper ends 40 of each ramp member curve outwardly from one another and therebetween create a cradle or recess 42 for selectively receiving and supporting the lower horizontal frame bar 14 of a swinging gate.

As shown, the vertical leg 41 and sloped leg 38 of each ramp member are integrally formed from a single elongated member which is properly shaped to the desired configuration and subsequently welded or otherwise attached to the base member 25. However, both ramp members may be formed from a single stock of material as, for example, a solid block having opposing inclined surfaces which are separated at their uppermost portions by a concave or depressed area which defines a seat for selectively retaining the lower frame bar or lowest portion of a swinging gate.

The cradle 42 of each gate rest is disposed generally centrally of the base midway between the sides 30 and 31 of the base and adjacent one of the ends and thus the weight of the gate supported thereby is stabilized by the base member.

It is contemplated that one of the ramp members 35 or 36 could be higher than the other ramp member and function as a stop member to limit the swinging movement of the gates to one side of the fence. Also, if desired, a separate stop member (not shown) could be attached to either ramp member to limit the movement of the associated gate.

A generally cylindrical tubular socket member 45 is mounted generally centrally on the upper surface 26 of the base plate 25 and extends upwardly therefrom. The socket member is centered so as to be in general alignment with the cradles 42. The inner periphery of the socket is of a sufficient size to cooperatively receive the lower portion of the gate drop rod 20.

Although not shown, the socket member may be adjustably mounted on the upper surface 26 of the base plate. In this manner, the socket member may be selectively maneuvered so as to properly align and/or space the socket relative to the gate rests 32 and 33. Thereafter, the socket member need only be tightened into intimate contact with the base plate.

The gate retainer 10 will generally be constructed of a rigid metal material although other durable materials, such as hard rubber, thermoplastic material and the like could be used. In order to install the gate retainer 10 over an existing surface, the retainer is properly aligned and positioned generally along the arc defined by the free end of the swinging gate and in proper position to both support the ends of the swinging gate and selectively receive the tip of the locking drop rod carried by the gate. Thereafter, nails, spikes, bolts or other fasteners 46 are inserted through openings 47 which are provided through the base plate 25 and into the surface material. If desired, the gate retainer may be installed in a surface material such as concrete or asphalt by embedding two or more bolts in the material with the threads of the bolts extending upwardly therefrom and thereafter placing the openings 47 of the base plate over the bolts and attaching the base plate thereto by nuts or the like.

Although the preferred embodiment discloses the use of a gate retainer having two gate rest members, it should be noted that only a single gate rest is necessary when the apparatus is employed to support a single swinging gate. Likewise, the number of socket members may be increased if each of two swinging gates carries a drop rod or vertically slidable latching member.

In use, once the swinging gates are mounted for pivotal movement, the exact position at which it is desired to support the gate in a locked position is determined. As shown in the drawings, the gate retainer is secured to the surface over which the gates extend and is positioned so that the lower frame bar of each gate will be cooperatively received and supported in one of the cradle members. It is apparent that the sloped surfaces of the gate rests will assist in elevating the free ends of the gates slightly as the gates are being brought into their cradle position. Additionally, the sloped surfaces of the gate rests will protect the socket member from damage caused by accidental vehicular traffic over the gate retainer.

The cradle members are designed to be of such a height so as to maintain the gate substantially horizontal and thereby prevent sagging of the gate. Once the gates are maneuvered into position in the cradle members, the drop rod carried by the gate is lowered and cooperatively received within the latch socket.

In some instances, it may be desired to install the gate retainer in some other position generally along the arc defined by the free end of a swinging gate. For example, a gate support could be installed to support and maintain a gate in a fully opened position.

I claim:

1. A retainer and support for the end portion of a swinging gate which has rod means carried thereby, the rod means being shiftable from a first retracted position for movement with the gate to a second position in which it is extended therefrom, comprising, plate means for positioning at substantially ground level at the desired location adjacent the arc of travel of the end portion of the gate, at least one support means extending upwardly from said plate means to an elevated position for selectively supporting the end portion of the gate in spaced relationship from the ground level, and said plate means including at least one socket means for reception of the rod means when the latter is in extended position and the end portion of the gate is disposed on said support means.

2. The invention of claim 1 in which said support means includes a ramp member having first and second inclined surface portions converging upwardly relative to one another from said plate means to adjacent said elevated position, and cradle means at said elevated position connecting each of said inclined surface portions for selectively receiving the end portion of the gate.

3. The invention of claim 1 including two support means in spaced relationship to one another extending upwardly from said plate means and said socket means being disposed between said support means.

4. A retainer and support for the end portions of two opposed swinging gates at least one of which has rod means carried thereby, the rod means being shiftable from a first position in which it is retracted for movement with the gate to a second position in which it is extended therefrom, comprising, plate means selectively locatable at substantially surface level at the desired position adjacent the arc of travel of the end portions of the gates, first and second support means disposed in spaced relationship on said plate means and extending upwardly therefrom to an elevated position, said first support means selectively supporting the end portion of one of the gates in spaced relationship from the surface level and said second support means selectively supporting the end portion of the other of the gates in spaced relationship from the surface level, and at least one socket means disposed between said first and second mounting means and extending upwardly from said plate means for reception of the rod means when the latter is in extended position and the end portions of the gates are disposed on the respective support means.

* * * * *